US006913094B2

(12) United States Patent
Youan et al.

(10) Patent No.: US 6,913,094 B2
(45) Date of Patent: Jul. 5, 2005

(54) LEADING BODY FOR GROUND DRILLING AND GROUND DRILLING MACHINE

(75) Inventors: Toyohiko Youan, Hirakata (JP); Kentaro Watanabe, Hirakata (JP); Eiichi Muramoto, Hirakata (JP); Touru Hishiyama, Hirakata (JP)

(73) Assignee: Komatsu Ltd., Tokyo (JP)

( * ) Notice: Subject to any disclaimer, the term of this patent is extended or adjusted under 35 U.S.C. 154(b) by 71 days.

(21) Appl. No.: 10/453,327

(22) Filed: Jun. 2, 2003

(65) Prior Publication Data

US 2003/0226692 A1 Dec. 11, 2003

(30) Foreign Application Priority Data

Jun. 7, 2002 (JP) ..... 2002-167684

(51) Int. Cl.[7] ..... E21B 10/60
(52) U.S. Cl. ..... 175/75; 175/393
(58) Field of Search ..... 175/73–75, 339, 175/393, 61, 62

(56) References Cited

U.S. PATENT DOCUMENTS

| | | | | |
|---|---|---|---|---|
| 4,674,579 A | * | 6/1987 | Geller et al. | 175/45 |
| 5,322,134 A | * | 6/1994 | Dahn | 175/21 |
| 6,263,984 B1 | * | 7/2001 | Buckman, Sr. | 175/67 |
| 6,530,439 B2 | * | 3/2003 | Mazorow | 175/89 |

* cited by examiner

*Primary Examiner*—Zakiya Walker
(74) *Attorney, Agent, or Firm*—Frishauf, Holtz, Goodman & Chick, P.C.

(57) ABSTRACT

A leading body for a ground drilling machine is provided which includes a main body which is tapered at a front end thereof to form a first sloped surface and a second sloped surface on opposite sides of the front end of the main body. A slant-cutting section extends from the main body substantially along the first sloped surface. And injection ports which are adapted to inject digging liquid are positioned in the slant-cutting section such that the injection ports inject digging liquid rearward with respect to a propelling direction of the leading body along an obtuse angle with respect to a rotation axis of the leading body and substantially along the second sloped surface.

2 Claims, 10 Drawing Sheets

LEADING BODY FOR GROUND DRILLING AND GROUND DRILLING MACHINE

BACKGROUND OF THE INVENTION

1. Field of the Invention

This invention relates to a leading body for drilling the ground and also to a ground drilling machine. More particularly, the present invention relates to a leading body for drilling the ground and also to a ground drilling machine to be used for drilling holes under the ground for the purpose of laying gas pipes, electric power cables, sheaths pipes for signal cables, optical fiber cables, water supply pipes, drainage pipes and so on without openly excavating the ground and also for drilling holes in rock beds in order to set dynamite there for blasting.

2. Description of Related Art

In recent years, efforts have been paid to develop ground drilling machines for drilling holes under the ground for the purpose of laying various pipes and cables without openly excavating the ground.

FIGS. 9 and 10 of the accompanying drawings schematically illustrate such a ground drilling machine 1. The illustrated ground drilling machine 1 comprises a horizontal drill unit 2 and a digging liquid supply vehicle 3 for supplying digging liquid to the horizontal drill unit 2. Rods 10 are sequentially fed out from the horizontal drill unit 2 in such a way that each succeeding rod is linked to the immediately preceding rod. A pilot head (drill) 20, which is a leading body, is rotatably fitted to the front end of the leading rod 10.

The ground drilling machine 1 is used with a horizontal drilling technique in order to lay pipes under the ground.

Firstly, the pilot head 20 is driven into the ground from en entrance pit A at a predetermined angle of inclination (10 to 20°). Then, after correcting the direction in which the pilot head 20 is propelled to a horizontal direction, the pilot head 20 is driven to rotate and dig the ground until it gets to starting pit B. Thereafter, the pilot head 20 is driven to rotate and dig a hole from the starting pit B to the destination pit C so as to produce a leading hole D. Between the starting pit B and the destination pit C, the position, the depth from the surface, the inclination, the rotary angle and so on of the pilot head 20 are detected by means of a magnetism detector located on the ground that detects the magnetic field produced by the transmitter (sonde) contained in the pilot head 20 so as to appropriately correct the direction in which the pilot head 20 is propelled while it is digging the leading hole D. During the digging operation, digging liquid that may be clean water, muddy water or bentonite solution is supplied from the digging liquid supply vehicle 3 and through the rods 10 and injected from the pilot head 20.

After digging the leading hole D, the pilot head 20 fitted to the front end is replaced by a reamer 30 for broadening the leading hole and the object of underground placement E that may be a pipe or a cable to be laid is connected to the reamer 30 by way of a swivel joint. Then, the reamer 30 is rotated back, while causing the reamer 30 to eject digging liquid, and the object of underground placement E is drawn into the hole, while broadening the leading hole D by means of the reamer 30.

During the above described operation of laying pipes under the ground, digging solution is injected from the pilot head 20 substantially in the direction of propelling the pilot head 20 in order to improve the efficiency of digging the leading hole D. The ground is loosened due to the injected liquid to facilitate the digging operation. Additionally, the injected digging solution is drained toward the starting pit B through the gap between the leading hole D and the rods 10 along with the dug soil. In other words, the injected digging solution also serves to deliver the dug soil.

However, the dug soil cannot be satisfactorily removed simply by means of the flow of digging solution when the digging efficiency of the ground digging machine is improved because a large volume of soil is dug in a very short period of time.

Additionally, if the dug soil is not removed efficiently, some of the dug soil remains near and in front of the pilot head 20 so that, if the revolving pilot head 20 is propelled further, the remaining dug soil is dug again to reduce the efficiency of digging the ground ahead of the pilot head 20. Furthermore, some of the dug soil can remain between the leading hole D and the pilot head 20 and/or between the leading hole D and the rods 10. Then, the load relative to the digging torque is reduced to further increase the digging efficiency.

SUMMARY OF THE INVENTION

Therefore, the principal object of the present invention is to provide a leading body for drilling the ground and a ground drilling machine that can maintain a high digging efficiency and remarkably improve the efficiency of removing the dug soil.

A leading body for drilling the ground according to the invention is characterized in that its paired digging solution injection ports are directed to the rear side relative the propelling direction thereof and angularly separated from the axial line thereof by an obtuse angle.

With the above defined arrangement of the leading body, since the injection ports are directed to the rear side relative to the propelling direction of the leading body, the flow rate of digging liquid flowing toward the starting pit is increased to efficiently deliver the soil dug by the digging operation so that the efficiency of removing dug soil is remarkably raised. Digging liquid can also be injected forward from some other injection port(s). Then, the leading body can dig the ground forward without difficulty because dug soil is efficiently moved away if the rate of injecting digging liquid forward is not high. In other words, the present invention does not adversely affect the digging efficiency of the leading body but maintains it to an enhanced level.

Preferably, a leading body for drilling the ground has a sloped surface section inclined toward the front end of the axis thereof and a slant-cutting section extending forward substantially along the sloped surface section and the injection ports are arranged at respective positions on the slant-cutting section, facing the sloped surface section, and directed so as to inject digging liquid along the sloped section located opposite to the sloped surface section.

With such an arrangement of the leading body, dug soil can easily flow rearward along the sloped section located near the front end and the rate at which dug soil flows is increased by the digging liquid that is injected along the sloped section to consequently raise the efficiency of removing dug soil and also that of the digging operation.

In another aspect of the invention, there is provided a ground drilling machine comprising rods, a rod rotating mechanism for driving rods to rotate, a rod propelling mechanism for propelling rods, a leading body fitted to the front end of the rod and adapted to be rotated and propelled with the rod, the leading body being a leading body for drilling the ground according to claim 1 or claim 2.

Thus, a ground drilling machine comprising a leading body according to the invention provides the equivalent advantages described above for the leading body.

BRIEF DESCRIPTION OF THE INVENTION

DETAILED DESCRIPTION OF THE PREFERRED EMBODIMENTS

Figure 9:
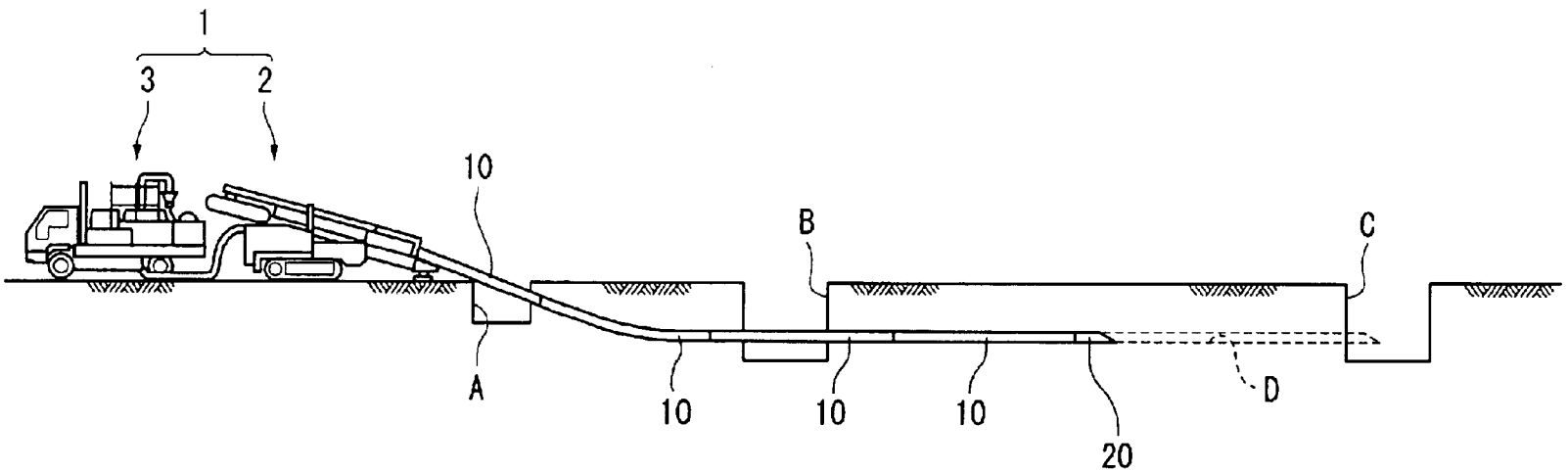
FIG. 9 is a schematic illustration of the related background art.
Figure 10:
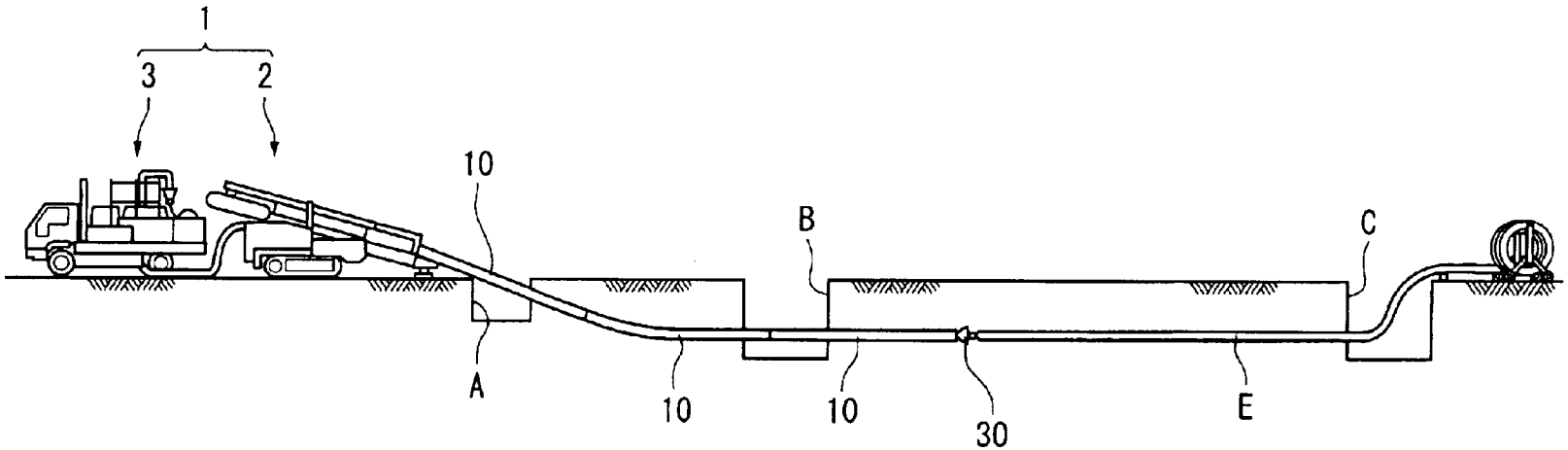
FIG. 10 is another schematic illustration of the related background art.

Now, the present invention will be described by referring to the accompanying drawings that illustrate preferred embodiments of the invention. In the drawings illustrating the first embodiment, the components thereof that are the same as or similar to those (illustrated in FIGS. 9 and 10 and) described above for the related background art are denoted respectively by the same reference symbols. In the drawings illustrating the second and other embodiments again, the components thereof that are the same as or similar to those of the first embodiment are denoted respectively by the same reference symbols and will not be described any further.

[1st Embodiment]

Figure 1:
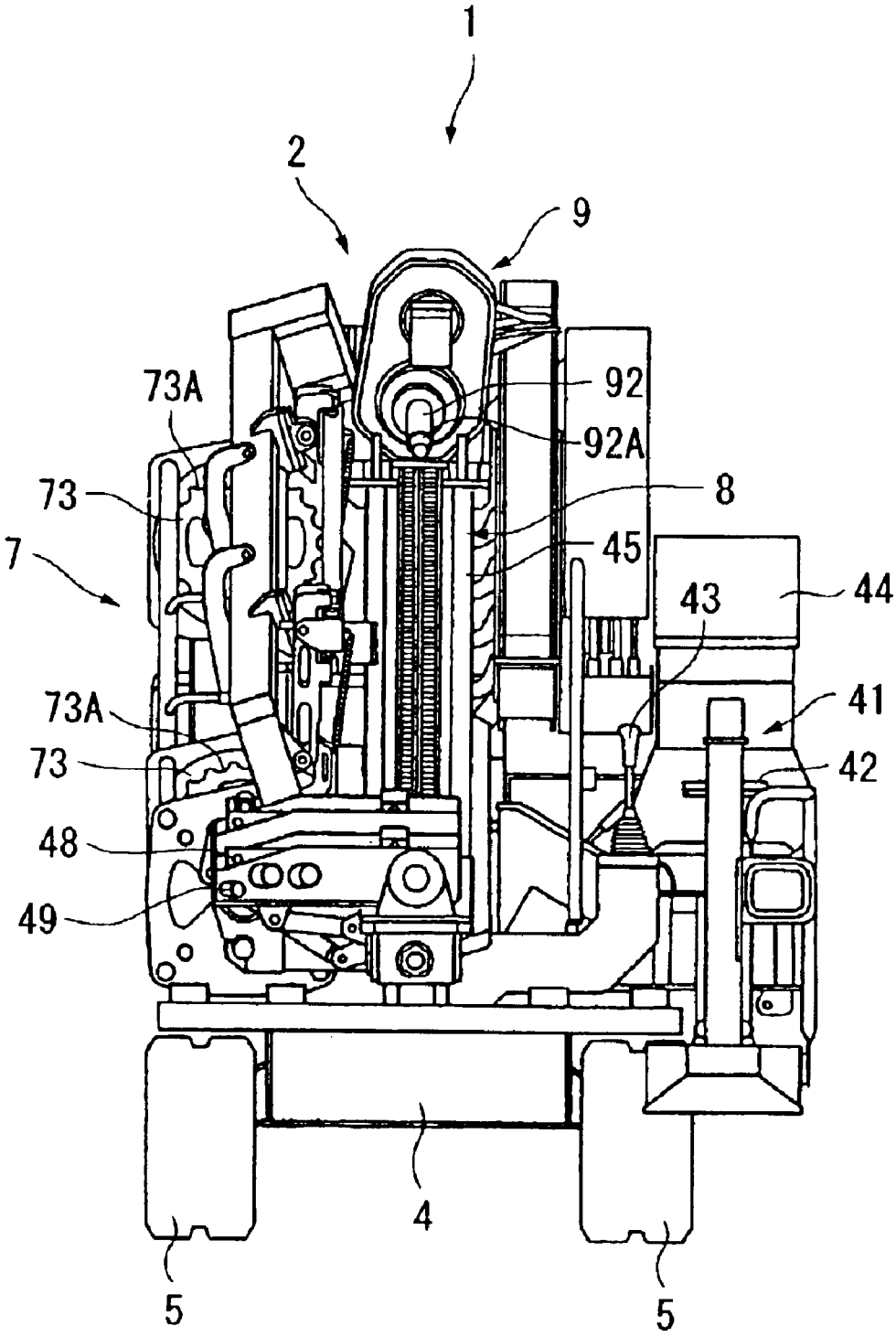
FIG. 1 is a schematic front view of the horizontal drill unit of the first embodiment of ground drilling machine according to the invention.
Figure 2:
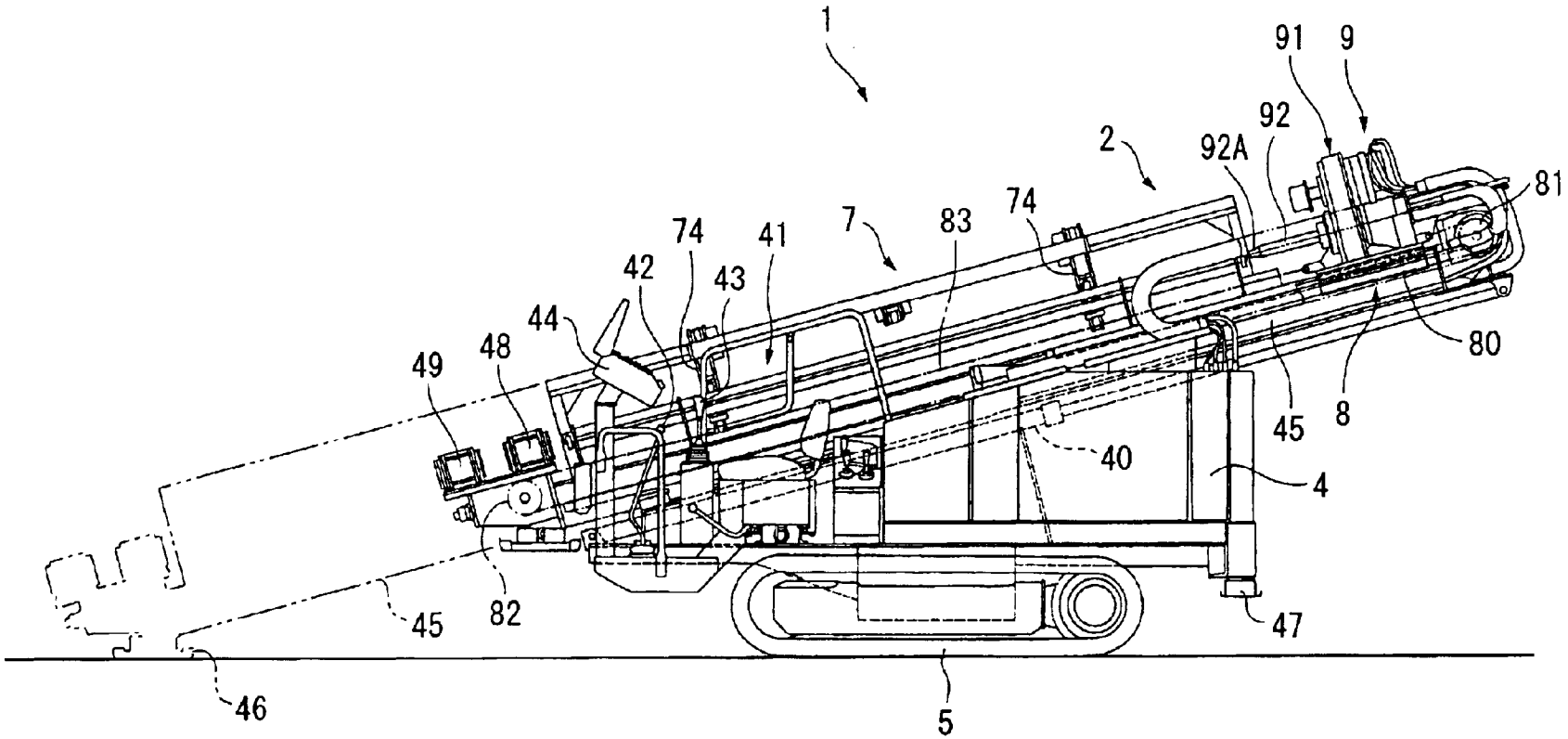
FIG. 2 is a schematic lateral view of the horizontal drill unit of FIG. 1.
Figure 3:
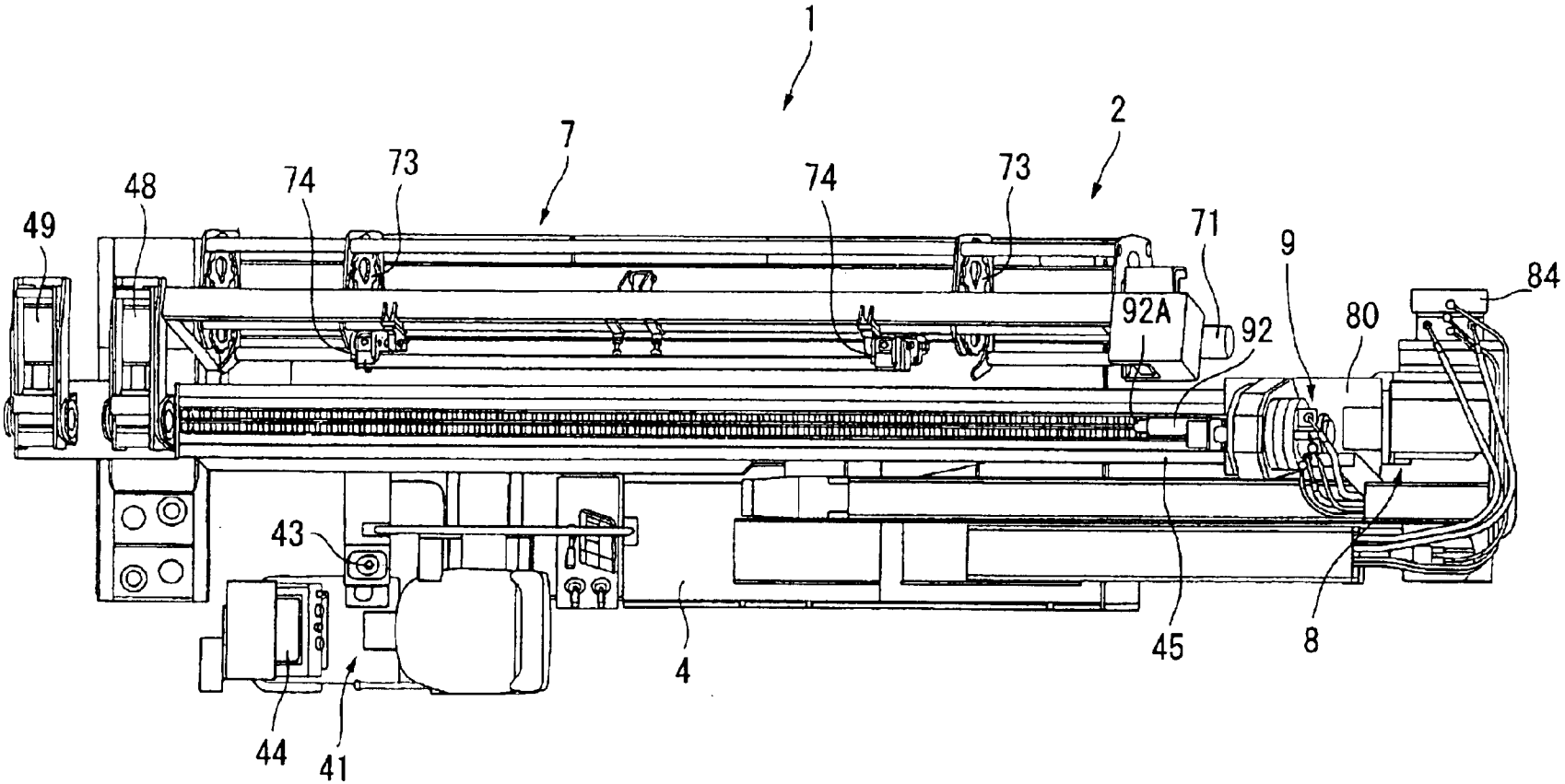
FIG. 3 is a schematic plan view of the horizontal drill unit of FIG. 1.

FIGS. 1, 2 and 3 are respectively a schematic front view, a schematic lateral view and a schematic plane view of the horizontal drill unit 2 of the first embodiment of ground drilling machine 1 according to the invention.

Referring FIGS. 1 through 3, the horizontal drill unit 2 comprises a vehicle body section 4 having a slope section at the top thereof, a pair of crawler type lower traveling bodies 5 arranged under the vehicle body section 4, a drive source (not shown) arranged inside the vehicle body section 4, a rod switching device 7 arranged on the vehicle body section 4 so as to be able to contain a plurality of rods 10 (FIGS. 9, 10), a rod propelling mechanism 8 for propelling the rod 10 fed from the rod switching device 7, a rod rotating mechanism 9 for rotating the rod 10 fed to the rod propelling mechanism 8 and a controller (not shown) for automatically controlling the flow rate of digging liquid being injected from a pilot head 20 (leading body).

With the horizontal drill unit 2, a number of rods 10 drawn out of the rods contained in the rod switching device 7 are sequentially and linearly linked and driven forward by the rod propelling mechanism 8, while they are rotated by the rod rotating mechanism 9 so as to be able to dig a leading hole D by means of the pilot head 20 fitted to the front end of the rods 10 in a manner as described earlier by referring to FIGS. 9 and 10. Then, it is possible to replace the pilot head 20 by a reamer 30 in order to draw in the object of underground placement E and bury it in the ground. Now, each of the components of the horizontal drill unit 20 will be described below.

The vehicle body section 4 is provided with a cab 41 in which the operator can sit and operate the horizontal drill unit 2. The cab 41 is so designed that, whenever necessary, it can be moved sideways to shift the operator's sitting position. The cab 41 is provided with a travel lever 42 for maneuvering the lower traveling bodies 5 along with a joystick type operation lever 43 for operating the rod propelling mechanism 8 and the rod rotating mechanism 9 and a control panel 44 on which various indicators are arranged.

The lower traveling bodies 5 are provided with respective hydraulic motors (not shown), which are driven by hydraulic pressure applied thereto from the drive source by way of respective control valves. The lower traveling bodies 5 are not limited to the crawler type but may be of the tire type or of the tire/crawler combination type. While the horizontal drill unit 2 is described above as of the automotive type that is provided with lower traveling bodies 5, it may alternatively be of the trailer type that is to be pulled by the digging liquid supply vehicle 3 or some other automotive vehicle for traveling.

The drive source typically comprises a diesel engine, a main hydraulic pump and a pilot pressure generating pump, of which the main hydraulic pump and the pilot pressure generating pump are driven to operate by the diesel engine. The main hydraulic pump is preferably of the variable capacity type having a swash plate that is driven to operate by a cylinder, which is by turn driven to operate by the pilot pressure according to the command from the controller.

The rod switching device 7 is arranged integrally with and along the longitudinal direction of the frame 45 that is disposed on the vehicle body section 4. It has a rotary shaft to be driven to rotate by a hydraulic motor 71. A pair of disk-shaped rod holding plates 73 is fitted to the rotary shaft with a gap interposed between them in the longitudinal direction. Each of the rod holding plates 73 is provided with a number of arc-shaped recesses 73A along the outer periphery thereof so that each rod 10 is held in a pair of corresponding recesses 73A of the front and rear rod containing plates 73. Note that rods 10 are not shown in FIGS. 1 through 3.

When a right one of the rods 10 held by the rod holding plates 73 is located at a predetermined position as a result of the rotary motion of the plates 73, it is released from the rod holding plates 73 as it is grasped by a swinging rod switching arm 74 and automatically fed toward the rod propelling mechanism 8. On the other hand, the rod 10 that is relieved out of service is released from the rod propelling mechanism 8 is grasped by the rod switching arm 74 and automatically returned to the rod switching device 7.

The frame 45 is mounted on the vehicle body section 4 in such a way that it is longitudinally movable along the inclined part of the vehicle body section 4 and its rear part is linked to a front area of the vehicle body section 4 by way of a moving cylinder 40. In FIG. 2, solid lines show the position of the moving cylinder 40 when it is extended. At this position, the frame 45 is entirely supported by the vehicle body section 4. On the other hand, as the moving cylinder 40 is retracted as shown by broken lines in FIG. 2, the frame 45 is moved forward along the inclined part until the anchor securing section 46 is grounded and the rod switching device 7 is held to the working position along with the rod propelling mechanism 8. The outrigger 47 arranged at a rear part of the vehicle body section 4 may be operated whenever necessary for a digging operation.

The rod propelling mechanism 8 is provided with a cradle 80 that is adapted to slide back and forth on the frame 45. A driving sprocket 81 and a following sprocket 82 are arranged respectively at the rear end and at the front end of the frame 45 and the opposite ends of the chain 83 that is wound around the sprockets 81, 82 is linked to the cradle 80. Thus, the rod 10 that is fed onto the frame 45 moves forward with the cradle 80 as the driving sprocket 81 is driven to rotate forwardly by the oil hydraulic feed motor 84, whereas it moves backward as the driving sprocket 81 is driven to rotate backwardly.

The rod rotating mechanism 9 is provided with an oil hydraulic drill motor 91 fitted to the cradle 80. The revolutions of the drill motor 91 are output to the rotary shaft 92 by way of a reduction gear. A screw section 92A is fitted to the front end of the rotary shaft 92 and is driven into the female screw section formed at the rear end of the rod 10 for engagement.

The controller comprises a computer and is adapted to operate the control valves in the oil hydraulic circuit according to the various output signals from the travel lever 42 and the operation lever 43 and control the oil hydraulic motor for driving, the feed motor 84 of the rod propelling mechanism 8, the drill motor 91 of the rod rotating mechanism 9 and the hydraulic pump (not shown) for supplying digging solution.

The horizontal drill unit 2 is provided at the front end of the frame 45 with a rod wrench 48 and a rod clamper 49, which are exclusively used to connect rods 10 and separate them from each other, although they are not described in detail here in terms of structure.

Now, the operations of propelling a rod 10, retracting a rod 10 and connecting a rod 10 to and disconnecting it from another will be described below.

Figure 4B:
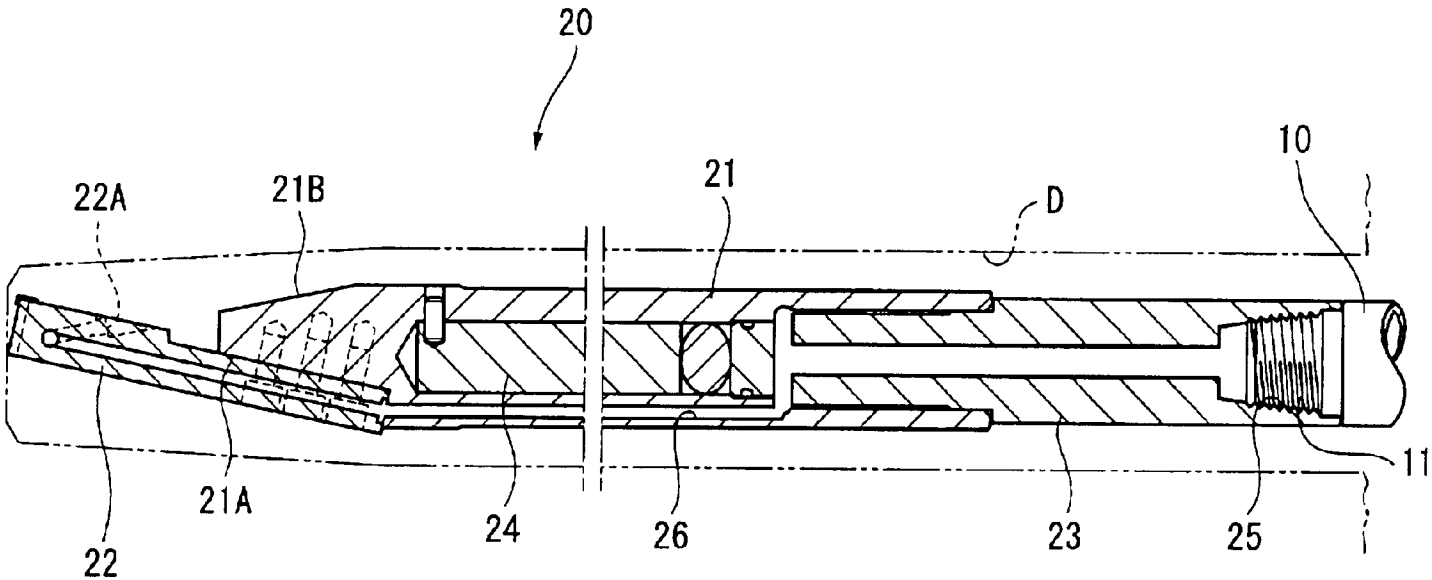
FIGS. 4A and 4B are a schematic longitudinal cross sectional view and a schematic transversal cross sectional view of the leading body of the first embodiment.
Figure 4A:
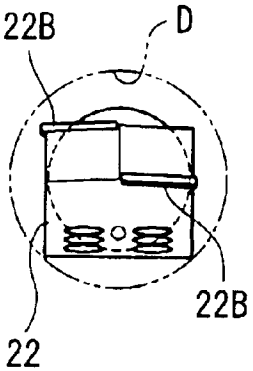

As a succeeding rod 10 is supplied from the rod switching device 7 to the rod propelling mechanism 8 while the rear end of a preceding rod 10 is clamped by the rod clamper 49, the succeeding rod 10 is driven to advance with the cradle 80 of the rod propelling mechanism 8 and pushed against the rear end of the preceding rod 10. As the rotary shaft 92 of the rod rotating mechanism 9 is driven to rotate under this condition, the rotary shaft 92 is screwed into the rear end of the succeeding rod 10 so as to become engaged with the latter. Then, the succeeding rod 10 is also driven to rotate so that the male screw section 11 (FIGS. 4A, 4B) at the front end thereof is driven into the female screw section of the preceding rod 10 for mutual engagement. At this time, the cradle 80 is driven to advance by the distance by which the rotary shaft 92 and the succeeding rod 10 proceed by the rotary motion. As a result, the preceding rod 10 is coupled to the succeeding rod 10.

Thereafter, as the rod clamper 49 is released and the feed transfer valve is switched to drive the feed motor 84 to revolve forwardly, the coupled rods 10 are driven to move forward by the rod propelling mechanism 8 for a digging operation. As the succeeding rod 10 comes to occupy the position of the preceding rod 10, its rear end is clamped by means of the rod clamper 49 and the drill motor 91 is driven to revolve backwardly to release the rotary shaft 92. As a result, the cradle 80 is moved backward to its original position in order to wait for the supply of the next rod 10.

On the other hand, when the digging operation comes to an end and the succeeding rod 10 is released from the preceding rod 10, the cradle 80 is moved back to its rear position and the rear end of the preceding rod 10 is clamped by the rod clamper 49 while the front end of the succeeding rod 10 is held by the rod wrench 48 under the condition where the preceding rod 10 and the succeeding rod 10 are coupled together and the rotary shaft 92 is held in engagement with the rear end of the succeeding rod 10. Under this condition, the holding section of the rod wrench 48 is driven to rotate by means of a link mechanism using a cylinder in order to release the front end of the succeeding rod 10 from the rear end of the preceding rod 10 and separate the two rods 10 from each other. Subsequently, the drill revolution selector valve 95 is switched to driven the drill motor 91 to revolve backwardly in order to release the succeeding rod 10 from the rotary shaft 92 while the front end of the succeeding rod 10 is held by the rod wrench 48. Finally, the succeeding rod 10 is returned from the rod propelling mechanism 8 by the rod switching device 7 and held at rest.

Now, the structure of the pilot head 20 of the drill will be specifically described below.

Referring to FIGS. 4A through 5C, the pilot head 20 comprises a hollow head main body 21, a slant-cutting section 22 formed at the front end of the head main body 21 and a coupling section 23 screwed into the rear end of the head main body 21.

A transmitter (sonde) 24 is contained in the head main body 21 so that the pilot head 20 can be detected to find out its position and the depth from the ground surface by detecting the direction and the intensity of the magnetic field generated by the transmitter 24 by means of a magnetism detector on the ground. Additionally, it is also possible to detect the angle of inclination of the pilot head 20 relative to a horizontal and the direction (rotary angle) of the slant-cutting section 22 by way of the magnetic communication from the transmitter 24 to the magnetism detector. The front end of the head main body 21 is made to show a frusto-conical profile having a tapered surface and a flat and sloped surface section 21A that is inclined toward the front end of the axis of the head main body 21 is formed at a part of the frustum of cone.

The slant-cutting section 22 is formed by using a rectangular plate member that is rigidly secured to the sloped surface section 21A of the head main body 21 by six bolts. It is extended forwardly further from the front end of the head main body 21. Due to the provision of the slant-cutting section 22, the inner diameter of the leading hole D dug by the rotary motion of the pilot head 20 is made slightly greater than the outer diameter of the head main body 21 and a gap is produced between the leading hole D and the pilot head 20 for allowing the soil produced by digging to flow backward with digging liquid. When the pilot head 20 is forced to move forward without rotating, the slope of the slant-cutting section 22 is subjected to reaction force and hence the moving direction of the pilot head 20 is shifted to make it move along the slope. For instance, if the slant-cutting section 22 takes the position shown in FIGS. 4A and 4B, the pilot head 20 is forced to advance gradually upwardly as it moves forward.

A tapered female screw section 25 is formed at the rear end of the coupling section 23 and the male screw section 11 arranged at the front end of the rod 10 is driven into it for mutual engagement.

The pilot head 20 is provided in the inside thereof with a digging liquid flow path 26 that runs through the head main body 21, the slant-cutting section 22 and the coupling section 23. Thus, digging liquid firstly flows through the hollow section in the inside of the rod 10 and goes into the pilot head 20 by way of the female screw section 25 and then it flows through the digging liquid flow path 26 before it is injected from injection ports 22A.

Figure 5A:
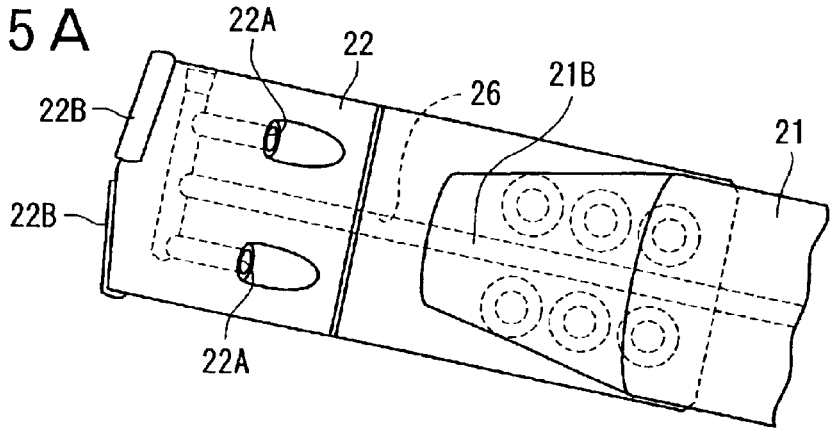
FIGS. 5A, 5B and 5C are a schematic plan view, a schematic lateral view and a schematic bottom view of a principal part of the leading body illustrated in enlarged dimensions.
Figure 5B:
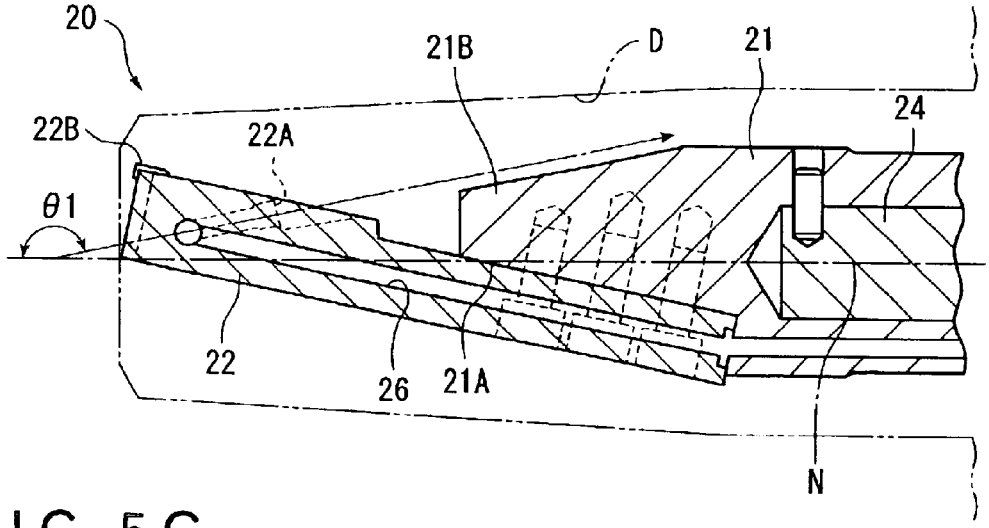
Figure 5C:
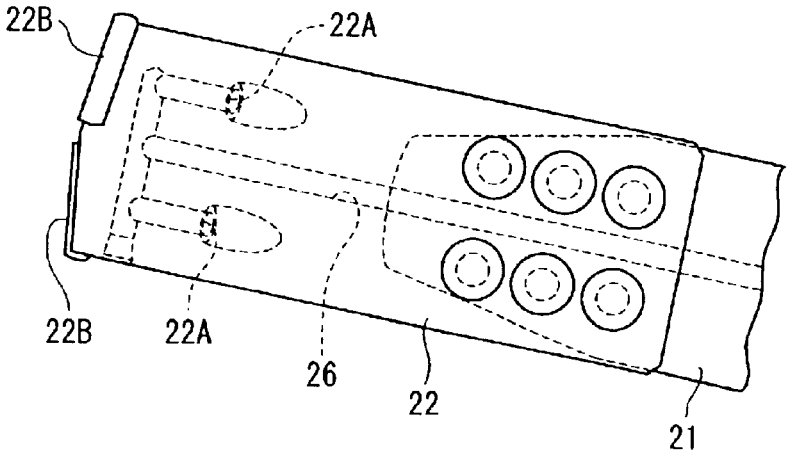

More specifically, as shown in FIGS. 5A through 5C, the digging liquid flow path 26 is branched at a front end side thereof to two lateral sides of the slant-cutting section 22 and the front ends of the branches are respectively held in communication with a pair of injection ports 22A that are directed rearward (in the direction opposite to the propelling direction of the pilot head 20). Note that one of the branches is blocked by a plug or the like in order to prevent digging solution from flowing out.

The injection ports 22A are located at the side of the sloped surface section 21A of the extended slant-cutting section 22 and their axial lines are separated angularly backwardly from the axis of rotation (axial line) N of the pilot head 20 by angle θ1. The angle θ1 is an obtuse angle as seen from the cross sectional view of FIG. 5B. In this embodiment, the angle θ1 is made equal to 168°. As shown in the cross sectional view of FIG. 5B, the injection ports 22A of this embodiment are directed such that they inject digging liquid along the sloped section 21B located opposite to the sloped surface section 21A relative to the axis of rotation N and hence along the slope of the above described frusto-conical section.

Digging liquid is supplied from the digging liquid supply vehicle 3 to the rods 10 by way of the rotary shaft 92 of the reduction gear that is driven by the drill motor 91. The front end of the slant-cutting section 22 is slightly projecting at the center thereof and a pair of hardened parts 22B having a predetermined length are diagonally arranged relative to the center and fitted to the sloped areas of the front end of the slant-cutting section 22 as claddings by welding for the purpose of reducing the abrasion of the slant-cutting section 22 when it is driven to revolve for the purpose of digging the ground.

Thus, the pilot head 20 is propelled to dig the leading hole D. When the pilot head 20 is driven to move straight ahead, it is driven to revolve and, at the same time, digging liquid is injected from it. To shift the direction of propelling the pilot head 20, on the other hand, it is desirable that the pilot head 20 is simply propelled without being driven to revolve and without injecting digging liquid. However, when shifting the direction of propelling the pilot head 20 without driving it to revolve, there may be occasions where digging liquid needs to be injected at a certain high or low late depending on the circumstances.

This embodiment provides the following advantages.

(1) Since the injection ports 22A for injecting digging liquid of the pilot head 20 of the ground drilling machine 1 are directed rearward and angularly separated from the axis of rotation N of the pilot head 20 by an obtuse angle of θ1, it is possible to increase the flow rate of digging solution flowing from the front end of the leading hole D toward the starting pit B when digging the leading hole D from the starting pit B so that the dug soil produced by the digging operation can be removed efficiently to remarkably increase the soil delivering efficiency.

(2) While this embodiment is not adapted to inject digging liquid forwardly, it does not adversely affect the ground digging efficiency because dug soil is easily moved away to facilitate the operation of digging the ground forwardly.

Rather, as a result of an increased flow rate of digging liquid flowing toward the starting pit B, dug soil can hardly remain in the gap between the leading hole D and the pilot head 20 and between the leading hole D and the rods 10 so that the load relative to the digging torque is reduced to further increase the digging efficiency.

(3) Additionally, since digging liquid is injected from the injection ports 22A to flow rearward along the slope of the sloped section 21B arranged near the front end of the head main body 21, dug soil can easily flow rearward along the sloped section 21B at an enhanced flow rate to consequently raise the efficiency of removing dug soil and also that of the digging operation.

(4) Particularly, since the sloped section 21B is realized in the form of a tapered surface of a frustum of cone in this embodiment, the dug soil that will otherwise remain in front of the frustum of cone can be made to flow rearward smoothly to further improve the soil removing efficiency.

(5) Since a pair of injection ports 22A is provided in lateral direction of the slant-cutting section 22, dug soil can be delivered uniformly and efficiently.

[2nd Embodiment]

Figure 6A:
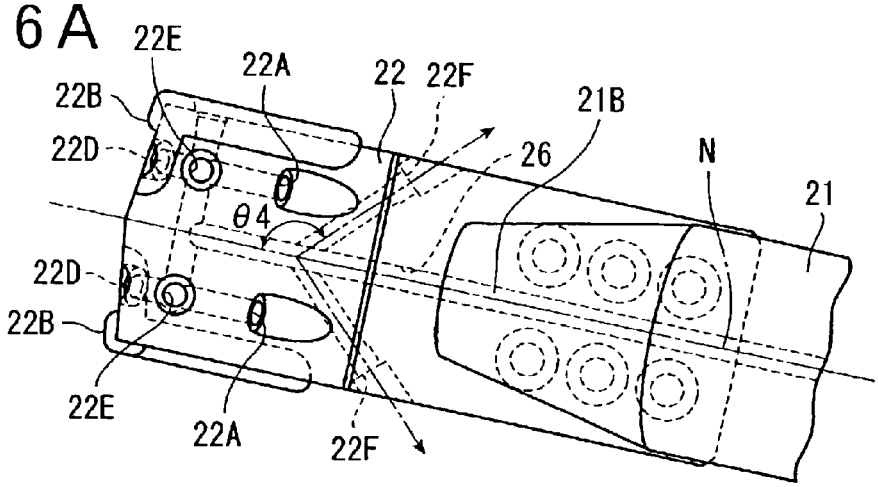
FIGS. 6A, 6B and 6C are a schematic plan view, a schematic lateral view and a schematic bottom view of a principal part of the leading body of the second embodiment of the invention illustrated in enlarged dimensions.
Figure 6B:
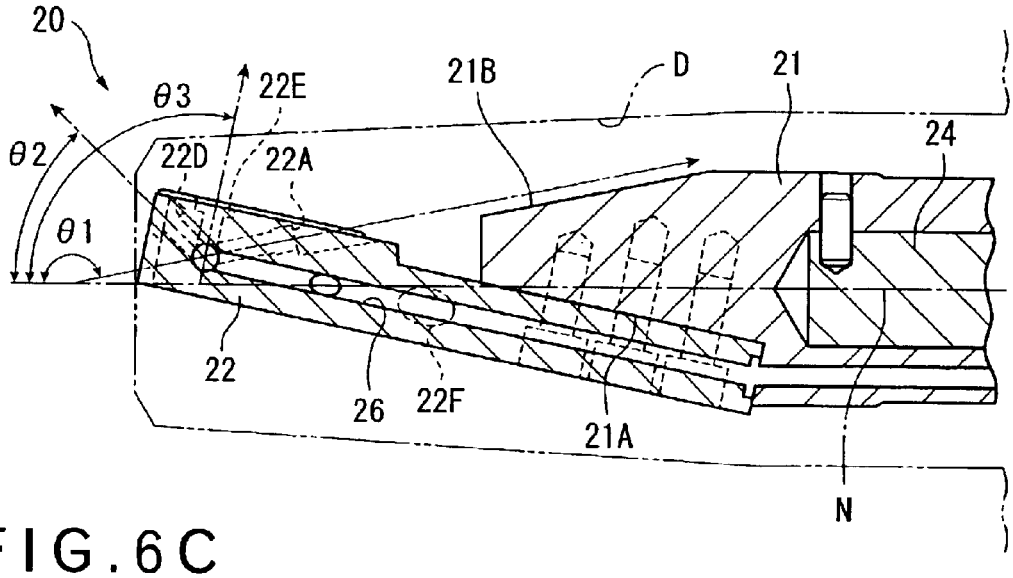
Figure 6C:
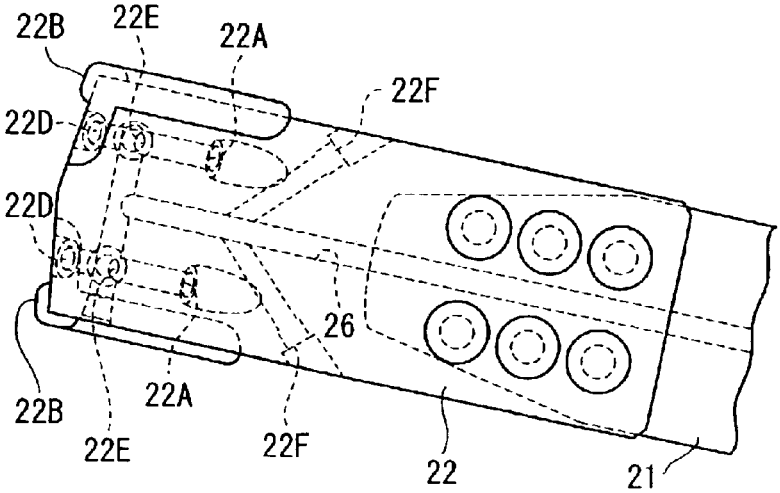

FIGS. 6A through 6C schematically illustrate the pilot head 20 of the second embodiment of the invention. In this embodiment, the pilot head 20 has a second pair of injection ports 22D that is inclined from the axis of rotation N by an angle of θ2 in cross section and adapted to inject digging liquid forward, a third pair of injection ports 22E that is inclined from the axis of rotation N by an angle of θ3 in cross section and adapted to inject digging liquid rearward and a fourth pair of injection ports 22F that is inclined from the axis of rotation N by an angle of θ4 in plan view and adapted to inject digging liquid rearward in addition to the first pair of injection ports 22A that is identical with its counterpart of the first embodiment. The angle θ2 is an acute angle of 45°, whereas the angles θ3 and θ4 are obtuse angles of 102° and 120° respectively.

The injection ports 22D are arranged on the front facet of the slant-cutting section 22 and the injection ports 22E are arranged on the surface where the injection ports 22A are located. To the contrary, the injection ports 22F are arranged at the opposite lateral surfaces of the slant-cutting section 22 and directed so as to inject digging liquid branched from the middle of the digging liquid flow path 26 rearward along the tapered surface of the frustum of cone.

This embodiment provides the following advantage in addition to the above described advantages (1) through (5).

(6) Since the injection ports 22D are arranged at the slant-cutting section 22 to inject digging liquid forwardly along the direction in which the pilot head is propelled, they can be used to conveniently loosen and break the ground in front of the pilot head so as to improve the digging efficiency.

Furthermore, since the injection ports 22E are arranged on the surface where the injection ports 22A are located and the injection ports 22F are arranged at the opposite lateral surfaces of the slant-cutting section 22, dug soil can be reliably removed to improve the soil removing efficiency by means of the injection ports 22A, 22E and 22F if a dug soil is produced at an enhanced rate to raise the digging efficiency.

[3rd Embodiment]

Figure 7A:
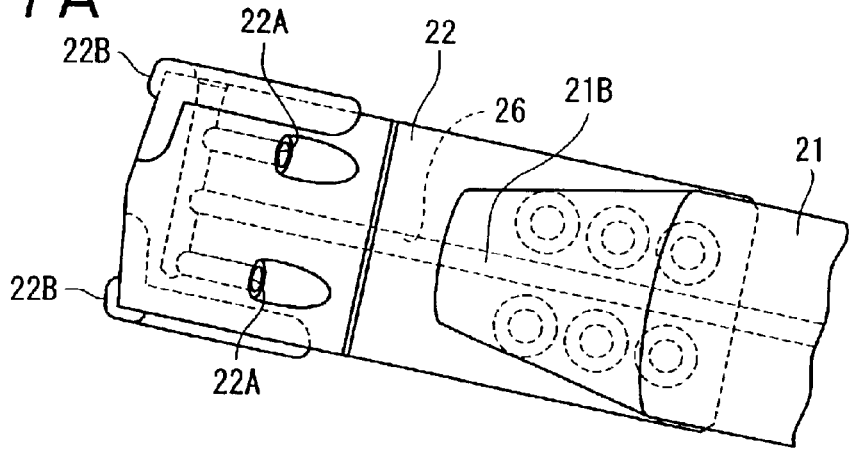
FIGS. 7A, 7B and 7C are a schematic plan view, a schematic lateral view and a schematic bottom view of a principal part of the leading body of the third embodiment of the invention illustrated in enlarged dimensions.
Figure 7B:
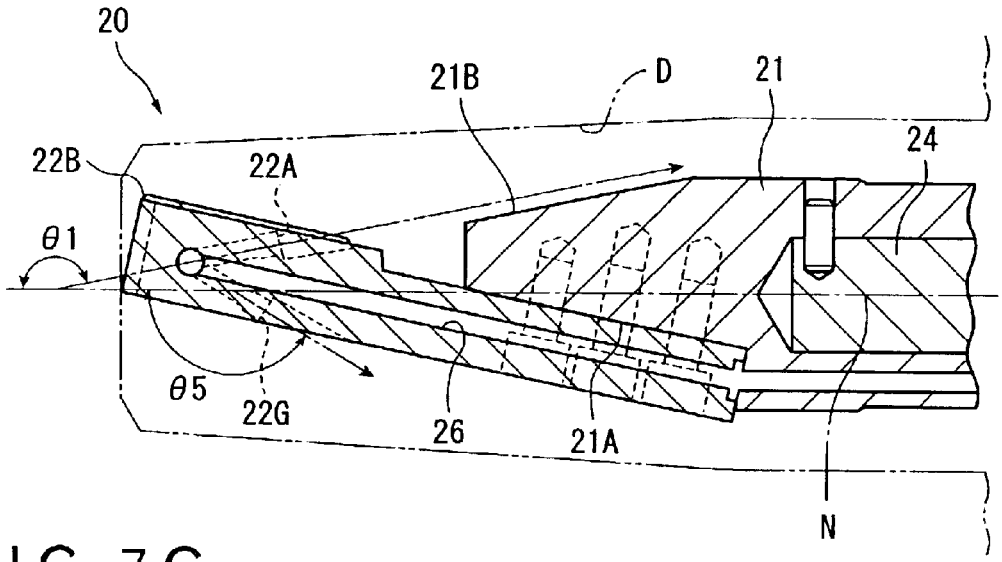
Figure 7C:
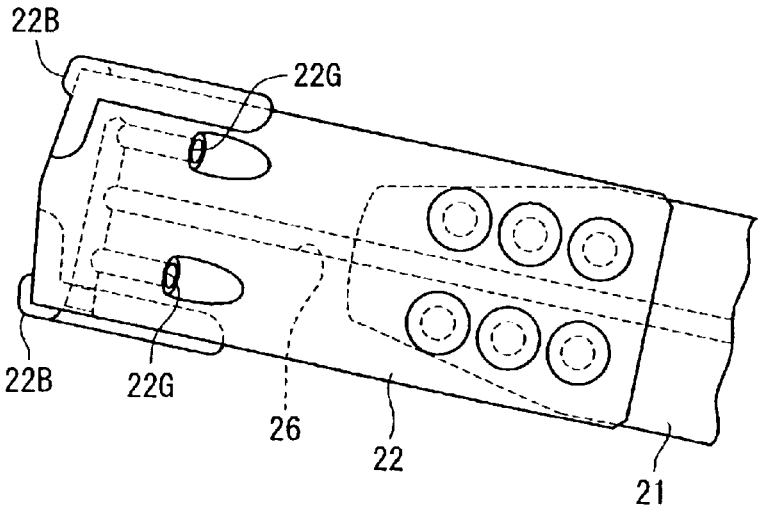

FIGS. 7A through 7C schematically illustrate the pilot head 20 of the third embodiment of the invention. In this embodiment, the slant-cutting section 22 has a second pair of injection ports 22G that is arranged on a surface opposite to the injection ports 22A and inclined from the axis of rotation N by an obtuse angle of θ5 in cross section, which is equal to 150°, so as to inject digging liquid rearward.

This embodiment also provides the above described advantages (1) through (5) and can further improve the soil removing efficiency due to the provision of the injection ports 22G.

[4th Embodiment]

Figure 8A:
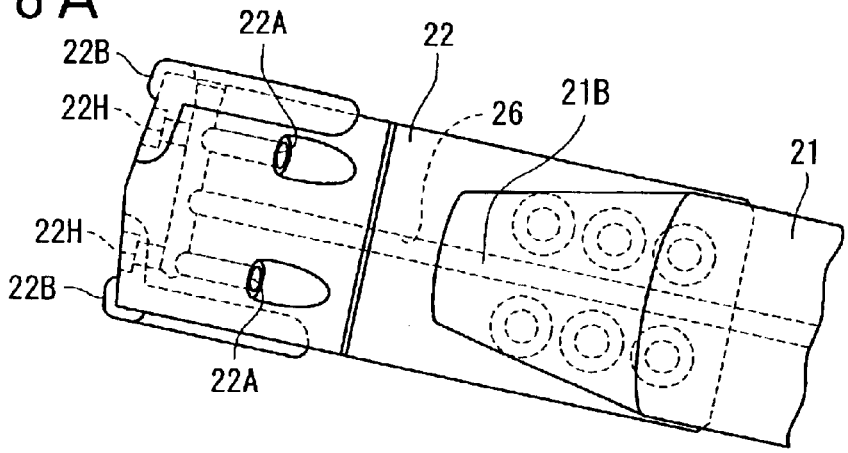
FIGS. 8A, 8B and 8C are a schematic plan view, a schematic lateral view and a schematic bottom view of a principal part of the leading body of the fourth embodiment of the invention illustrated in enlarged dimensions.
Figure 8B:
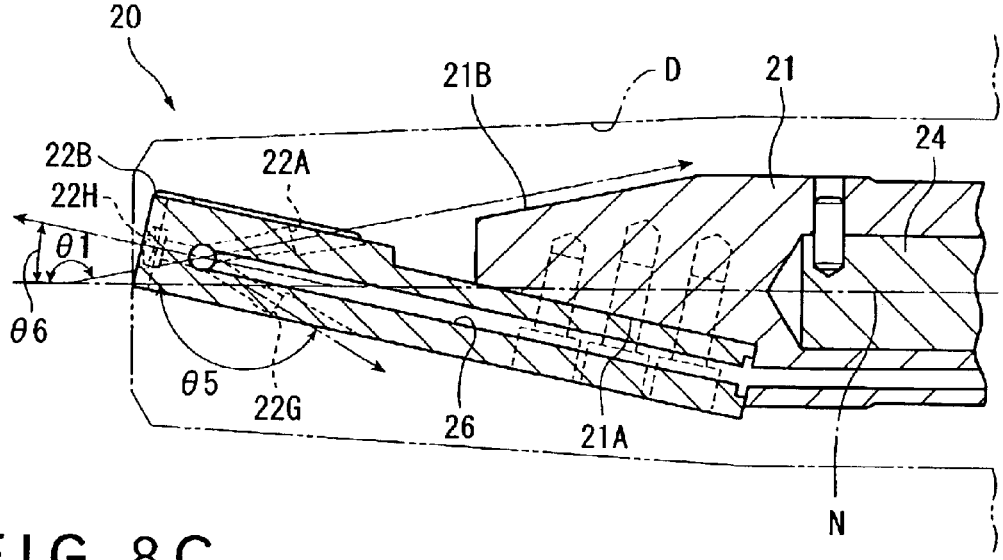
Figure 8C:
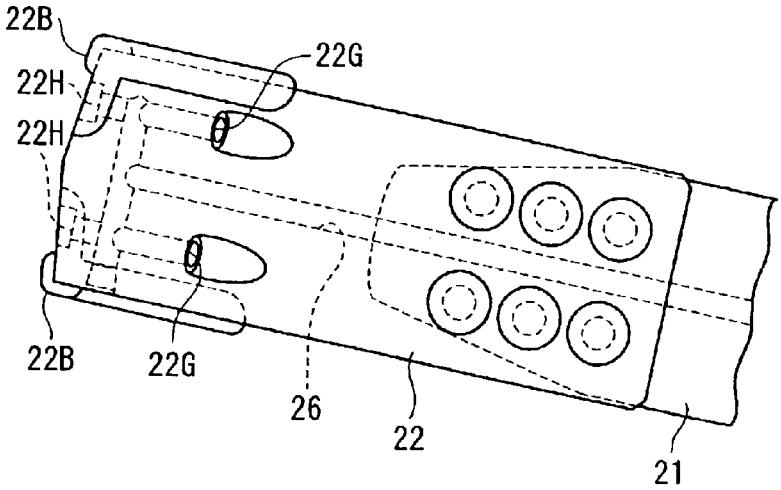

FIGS. 8A through 8C schematically illustrate the pilot head 20 of the fourth embodiment of the invention. This embodiment differs from the third embodiment in that it additionally has a pair of injection ports 22H that is arranged on the front facet of the slant-cutting section 22. The injection ports 22H are directed in such a way that they can inject digging liquid forward along the slope of the slant-cutting section 22 and angularly separated from the axis of rotation N by an acute angle θ6 of 12E. The area of the injection ports 22H is smaller than that of each of the pairs of injection ports 22A and 22G. In other words, the injection ports 22A, 22G can inject digging liquid at a higher rate.

This embodiment also provides the above described advantages (1) through (5) and can further improve the soil removing efficiency due to the provision of the injection ports 22G and also the digging efficiency due to the provision of the injection ports 22H. Additionally, since the area of the injection ports 22H is smaller than that of each of the pairs of injection ports 22A and 22G digging liquid would not be injected forward excessively so that too much dug soil would not be produced to remain in the leading hole D for a prolonged period of time.

[Modifications to the Embodiments]

The present invention is by no means limited to the above described embodiments, which may be modified or altered in many different ways, and may be embodied in many other different ways without departing from the spirit and scope of the invention.

For example, while the slant-cutting section 22 and the head main body 21 are provided as separate members and put together by means of bolts in each of the above embodiments, they may be integrally formed from the beginning by molding or forging. Then, the virtual surface formed along the boundary of the slant-cutting section 22 and the head main body 21 operates as the sloped surface section of any of the embodiments of the invention.

While the injection ports 22A of each of the above embodiments are directed in such a way that digging liquid is injected along the sloped section 21B in cross section, they may alternatively be directed in such a way that digging liquid is injected along the sloped section 21B in plan view. Then, digging liquid will be injected rearward from the paired injection ports 22A so as to slightly spread aside.

The pilot head 20 may be provided only with a pair of injection ports 22E, a pair of injection ports 22F or a pair of injection ports 22G without departing from the scope of the invention.

Alternatively, the pilot head 20 may be provided with a combination of any of the pairs of injection ports 22A, 22E, 22F, 22G without departing from the scope of the invention.

The injection ports of the present invention may be angularly separated from the axis of rotation of the pilot head 20 by any angle so long as the angle is obtuse. In other words, the angle is by no means limited to those cited above for the embodiments.

Furthermore, the number of each of the sets of injection ports 22A, 22D through 22H is by no means limited to two. In other words, an appropriate number may be selected for each set of injection ports depending on the positions, the angle from the axis of rotation N and the area of the injection ports.

What is claimed is:

1. A leading body for drilling in the ground, said leading body comprising:

a main body which is tapered at a front end thereof to form a first sloped surface and a second sloped surface on opposite sides of the front end of the main body;

a slant-cutting section extending from the main body substantially along the first sloped surface; and injection ports which are adapted to inject digging liquid and which are positioned in the slant-cutting section such that the injection ports inject the digging liquid rearward with respect to a propelling direction of the leading body along an obtuse angle with respect to a rotation axis of the leading body and substantially along the second sloped surface.

2. A ground drilling machine comprising:

at least one rod;

a rod rotating mechanism for rotating the rod;

a rod propelling mechanism for propelling the rod; and a leading body adapted to be fitted to a front end of the rod so as to be rotated and propelled with the rod;

wherein the leading body comprises:

a main body which is tapered at a front end thereof to form a first sloped surface and a second sloped surface on opposite sides of the front end of the main body;

a slant-cutting section extending from the main body substantially along the first sloped surface; and injection ports which are adapted to inject digging liquid and which are positioned in the slant-cutting section such that the injection ports inject the digging liquid rearward with respect to a propelling direction of the leading body along an obtuse angle with respect to a rotation axis of the leading body and substantially along the second sloped surface.

* * * * *